United States Patent [19]

Neuharth

[11] 4,305,581

[45] Dec. 15, 1981

[54] PIVOTABLE PLAYING TABLE

[76] Inventor: Michael E. Neuharth, 683-45th Pl. S.E., Salem, Oreg. 97301

[21] Appl. No.: 67,545

[22] Filed: Aug. 17, 1979

[51] Int. Cl.[3] ..... A63G 31/00

[52] U.S. Cl. ..... 273/5 R; 273/3 B

[58] Field of Search ..... 273/4 C, 5 R, 5 B, 5 C, 273/2; 108/6, 15

[56] References Cited

U.S. PATENT DOCUMENTS

| | | | |
|---|---|---|---|
| 122,830 | 1/1872 | Hely | 273/5 R |
| 653,722 | 7/1900 | Zentner | 273/4 C |
| 747,097 | 12/1903 | Spalt | 273/5 R |
| 747,726 | 12/1903 | Karhan | 273/4 C |
| 1,410,171 | 3/1922 | Davis | 273/5 R |

*Primary Examiner*—Richard C. Pinkham
*Assistant Examiner*—T. Brown
*Attorney, Agent, or Firm*—Kolisch, Hartwell & Dickinson

[57] ABSTRACT

A billiard table with a frame and playing surface assembly pivotable about a horizontal axis to shift the plane of said assembly from a horizontal to a vertical position. Pedestals and displaced brackets hold the assembly in a horizontal position.

2 Claims, 3 Drawing Figures

PIVOTABLE PLAYING TABLE

This invention relates to a billiard table construction, and more particularly to a billiard table wherein provision is made for pivoting the playing surface of the table whereby when the table is not in use less space is taken up by the table, permitting other uses of the room in which the table is located.

The game of billiards has long been a popular pastime with people of all ages. In using the term "billiard table" it is intended to refer to any of the several games which are played with oblong tables and with cue stick and balls, whether such includes pockets, as in pocket billiards or pool, or whether such is without pockets, as in the case of three-cushion billiard tables. With the advent of new construction materials and techniques, billiard tables are more frequently found in private homes, even homes of modest size.

A billiard table, even if such has dimensions which are somewhat less than a recognized tournament table, is a relatively bulky piece of equipment so that considerable usable space is taken up in any room provided with such a table. What this invention concerns is a novel construction for a billiard table which permits the table surface of the table to be swung from a horizontal to a vertical position when the table is not in use. The table in this condition takes up only a fraction of the space otherwise occupied by the table.

While the advantages of a table which permits such an adustment are real, any construction which affords such an adjustment cannot sacrifice stability in the playing surface and lack of trueness in the playing surface. The game of billiards, for accuracy and maximum enjoyment, requires that the plane of the playing surface be truly horizontal and that the playing surface be held securely so as to withstand jarring, impacting of balls, etc.

Generally, an object of this invention is to provide an improved billiard table featuring a novel construction wherein the playing surface and associated framework may be moved from a horizontal to a vertical position with the table not in use, the table occupying minimal space when such an adjustment is made.

A further object of the invention is to provide an improved billiard table which permits such an adjustment in the playing surface without sacrifice of requisite stability required for maximum enjoyment of the game.

Yet another object of the invention is to provide such a table which is practical in operation, and of simple construction, rendering the table suitable for manufacture at low cost.

The table is attractive in appearance and offers minimal interference with normal player positioning in using the table.

These and other objects and advantages are attained by the invention, which is described hereinbelow in conjunction with the accompanying drawings, wherein.

Figure 1:
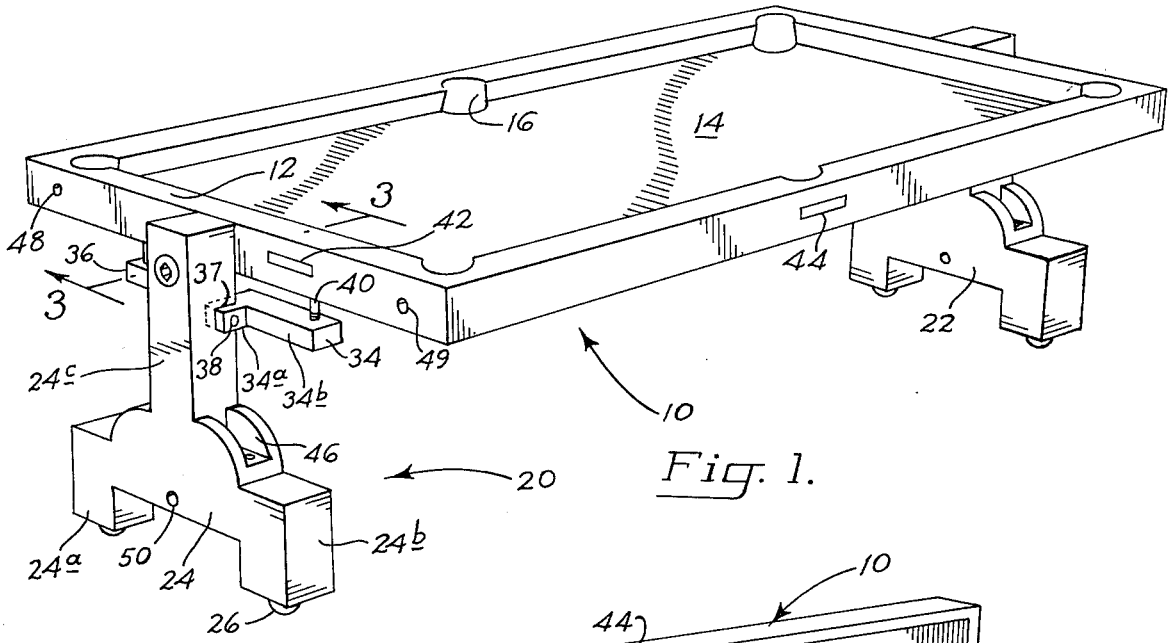
FIG. 1 is a perspective view illustrating a table as contemplated herein, and showing a frame and playing surface assembly disposed in a horizontal plane.

Referring now to the drawings, the billiard table illustrated comprises a rectangular frame and playing surface assembly 10 including a rectangular frame 12 encompassing a rectangular playing surface 14. The playing surface may be covered with the usual fabric found in billiard tables, and under the fabric a planar support 15, such as typifies billiard tables, providing suitable hardness and rigidity to the playing surface. The assembly illustrated includes pockets, such as the one as shown in 16, for receiving balls. The pockets may take any of various forms, and of course may be eliminated in a table designed for cushion billiards.

The frame and playing surface assembly is supported above the ground at convenient playing height by a pedestal means 20. Specifically, the pedestal means comprises a pair of spaced pedestals designated at 22 and 24, with one adjacent and outwardly of each of the opposite ends of assembly 10. Each pedestal includes a pair of spaced apart feet, exemplified by feet 24*a*, 24*b* and a central post extending upwardly from these feet, shown at 24*c*. The feet, therefore, engage the floor at points spaced laterally to either side of the post.

To aid in moving the table, the base of the feet may be supported on rollers partially shown at 26. Included in the mounting for the rollers is adjustable means which may be utilized in adjusting the spacing of the rollers relative to the bottom of the feet, which adjustment means may be used for making minor changes in the level of the playing surface to obtain a truly horizontal condition.

The pedestals are interconnected by an elongate bar or shaft 28 which spans the distance between the pedestals and extends through the frame and playing surface assembly. This bar or shaft is located below the sheet in this assembly which provides rigidity and firmness to the playing surface and supports the playing surface covering. Ends of the bar or shaft extend beyond the ends of the assembly 10 and are journaled as at 30 in upper portions of the posts found in the pedestals. Thus, the bar provides a pivot axis for assembly 10 which is horizontal and extends longitudinally of the assembly.

Each of the pedestals is provided with bracket means, more specifically a pair of brackets, such as shown at 34, 36, which are utilized in supporting the table firmly in a horizontal position. These brackets, which are also referred to herein as displaceable supports, are approximately L-shaped in configuration and include a short leg, such as shown as 34*a*, for bracket 34, and a longer leg, as exemplified by leg 34*b*. The pedestal is notched as at 37 to receive the short leg, and a detachable fastener 38 is utilized in securing the bracket in place on the post of the pedestal. With the pair of brackets so assembled on a pedestal, the brackets extend outwardly to either side of the pivot axis provided by bar 28.

Each of the brackets is provided with an adjustable means, exemplified by adjustable screw 40, which extends upwardly from a leg in the bracket and engages the undersurface of the frame in assembly 10. The adjustable means accommodate adjustments in the position of the assembly 10 whereby the assembly may be made to have a truly horizontal position extending between the brackets.

Levels are shown at 42, 44 promoting convenience in making necessary adjustments to obtain a truly horizontal position of assembly 10.

With further reference to a pedestal, it will be noted that a pocket or seat 46 is provided above foot 24*b* in pedestal 24, and a similar pocket is provided on the opposite side of the post in the pedestal. These seats or pockets are for the reception of the brackets 34, 36 when they are removed from the post. This is illustrated in FIG. 2, wherein it is seen that the brackets 34, 36 are seated in these pockets.

Figure 2:
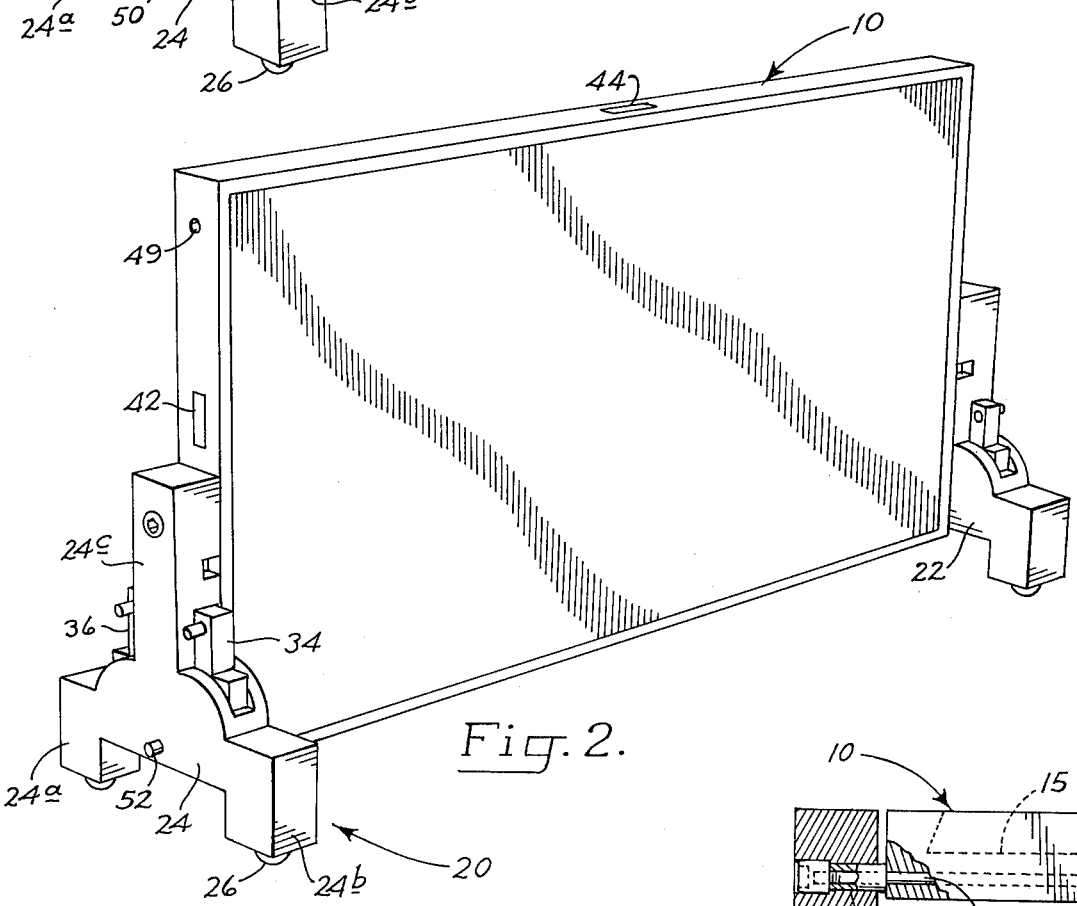
FIG. 2 is a view similar to FIG. 1, but showing the frame and playing surface assembly swung to a vertical position.
Figure 3:
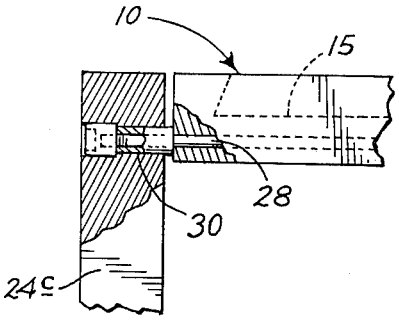
FIG. 3 is a cross-sectional view of portions of the table, taken along the line 3—3 in FIG. 1.

With removal of the brackets provided each of the pedestals, the frame and playing surface assembly 10 may be swung about a horizontal axis to place the assembly in the vertical position shown in FIG. 2. Movement of the assembly 10 may be in either of opposite directions, to place the undersurface of this assembly, as shown in FIG. 2, facing the viewer or, if desired, in the opposite direction (where such would be facing away from the viewer in FIG. 2). The particular adjustment made in the assembly would depend upon where the table is to be shifted in the room occupied by the table. It is convenient to prepare of the undersurface of assembly 10 with a covering whereby such may form a bulletin board when the table is not used for playing purposes. Apertures are provided at 48, 49 in assembly 10, and a bore shown at 50 extends through the pedestal adjacent its feet. These are utilized in locking assembly 10 in a vertical position, as by the insertion of the pin shown at 52 in FIG. 2 through the bore and the particular aperture that registers therewith.

With the table set up for the playing of billiards, a firm, secure positioning of assembly 10 is provided by the pedestals at each end which engage the floor at spaced to either side of the pivot axis for the table, and by the brackets described which support the frame on either side of this pivot axis. The pedestals provide minimal interference with movement of the players around the table. The detachable brackets are easily removed from their seated position in notches 36, 38 to free the playing surface for movement to the vertical position of FIG. 2. With the equipment as shown in FIG. 2, such may be moved over against the side of a room to free much of the space formerly taken up by the table.

It is contemplated that variations and modifications are possible in the invention without departing therefrom.

It is claimed and desired to secure by Letters Patent:

1. A billiard table comprising, a rectangular frame and playing surface assembly occupying a substantially horizontal position and including a rectangular frame encompassing a rectangular billiard playing surface, a pair of pedestals disposed with one adjacent and outwardly of each end of the frame and playing surface assembly, pivot means comprising an elongate bar having a horizontal axis pivotally mounting the assembly on said pedestals for pivotal movement about the axis of the bar from said horizontal to a vertical position, said bar extending along the length of the assembly and being disposed under said playing surface and having ends protruding beyond ends of the assembly, one end of the bar being mounted on one pedestal and the other end of the bar being mounted on the other pedestal and said bar providing the only connection between the pedestal, and a pair of brackets detachably connected to each pedestal, extending out to opposite sides thereof and support elements extending upwardly from the brackets engaging the underside of the frame and playing surface assembly and holding the assembly in its said horizontal position, said brackets on being detached from the pedestals freeing said assembly to swing about said axis to a vertical position each of said pedestals including a pair of pockets for seating respective brackets associated with the pedestal with the brackets detached from the pedestal.

2. A billiard table comprising a pair of spaced pedestals, a rectangular frame and playing surface assembly including a playing surface and rectangular frame surrounding the playing surface interposed between the pedestals, and pivot means mounting said assembly on said pedestals with the assembly extending in substantially a horizontal plane, said pivot means comprising an elongate bar extending along the length of the assembly and disposed under said playing surface and having ends protruding beyond the ends of the assembly and journaled on said pedestals, said bar accommodating pivoting of the assembly about a horizontal axis which coincides with the axis of the bar, said bar providing the only connection between the pedestals, and displaceable supports mounted on said pedestals engaging said assembly and holding the assembly in its said horizontal position, said supports comprising, for each pedestal, a pair of backets detachably secured to the pedestal projecting outwardly to opposite sides of the pedestal and the pivot axis afforded by said bar, said brackets having means engaging the assembly at points disposed on opposite sides of said bar and operable through such engagement to prevent the assembly from pivoting about said axis, detachment of said brackets freeing said assembly for pivotal movement, each of said pedestals including a pair of pockets for seating respective brackets associated with the pedestals with the brackets attached from the pedestals.

* * * * *